US007806190B2

(12) United States Patent
Du

(10) Patent No.: US 7,806,190 B2
(45) Date of Patent: Oct. 5, 2010

(54) CONTRACTION JOINT SYSTEM

(76) Inventor: Michael H. Du, 3711 Parkshire Dr., Pearland, TX (US) 77584

( * ) Notice: Subject to any disclaimer, the term of this patent is extended or adjusted under 35 U.S.C. 154(b) by 173 days.

(21) Appl. No.: 11/850,392

(22) Filed: Sep. 24, 2007

(65) Prior Publication Data

US 2009/0078430 A1 Mar. 26, 2009

(51) Int. Cl.
*E21B 17/00* (2006.01)

(52) U.S. Cl. ..... 166/380; 166/65.1; 166/242.7

(58) Field of Classification Search ..... 166/242.7, 166/242.2, 380, 65.1
See application file for complete search history.

(56) References Cited

U.S. PATENT DOCUMENTS 6,182,750 B1 2/2001 Edwards et al.
6,349,770 B1 * 2/2002 Brooks et al. ..... 166/383
6,920,932 B2 7/2005 Zimmerman
7,222,676 B2 5/2007 Patel
2005/0072564 A1 4/2005 Grigsby
2006/0000618 A1 1/2006 Cho
2006/0260803 A1 11/2006 Meijer
2006/0260817 A1 11/2006 Meijer
2006/0260818 A1 11/2006 Meijer
2007/0144746 A1 6/2007 Jonas
2008/0011907 A1 * 1/2008 Jacobsma ..... 248/62
2009/0032268 A1 * 2/2009 Blanton et al. ..... 166/386

* cited by examiner

*Primary Examiner*—William P Neuder

(57) ABSTRACT

A technique that prevents the tangling of communication lines routed along a contraction joint. The technique enables deployment of a well completion having a contraction joint with a plurality of communication lines routed along the contraction joint. A communication line organizer is positioned along the contraction joint to prevent tangling of the plurality of communication lines while enabling sufficient movement of the communication lines to accommodate expansion and contraction of the contraction joint.

24 Claims, 4 Drawing Sheets

CONTRACTION JOINT SYSTEM

BACKGROUND

In many well related operations, contraction joints are used with well completions to compensate for contraction and extension of the completion strings. The contraction and extension, however, increases the difficulty of routing communication lines along the completion string. Sometimes, a single communication line is wrapped around the contraction joint in a manner that allows it to contract or extend when the contraction joint is contracted or extended. The ability to freely contract and extend as the contraction joint moves helps maintain the integrity of the communication line.

Wrapping the communication line around the contraction joint is less helpful when using more than one communication line. The multiple communication lines become tangled with each other during operation of the contraction joint. Once tangled, the communication lines can become bound against portions of the contraction joint and fail to contract and extend uniformly. The communication lines are then susceptible to deformation and stretching beyond their material limits which causes catastrophic failure of the completion system.

SUMMARY

In general, the present invention facilitates the use of a well completion in combination with a plurality of communication lines. The invention provides a system and method to prevent the tangling of communication lines routed along a contraction joint of the well completion. Specifically, a communication line organizer, positioned us along the contraction joint, prevents tangling and binding of the plurality of communication lines while enabling sufficient movement of the communication lines to accommodate expansion and contraction of the contraction joint.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology that facilitates the use of a contraction joint in a well completion application. A communication line organizer enables the use of multiple communication lines for conducting signals downhole and/or uphole without tangling, deforming or otherwise impairing the operation of the communication lines. The communication line organizer can be used with two or more communication lines of the same or different types. For example, hydraulic communication lines, electrical communication lines (data and/or power), optical communication lines, and/or other types of communication lines can be routed in a variety of combinations along the contraction joint for signal communication with the completion string or with other downhole components. The communication line organizer allows the contraction joint to contract and expand without causing the communication lines to tangle or bind. The communication line organizer also can be used to provide a bearing effect between the communication lines and a mandrel of the contraction joint to facilitate smooth movement of the communication lines along the outer mandrel surface during operation.

Figure 1:
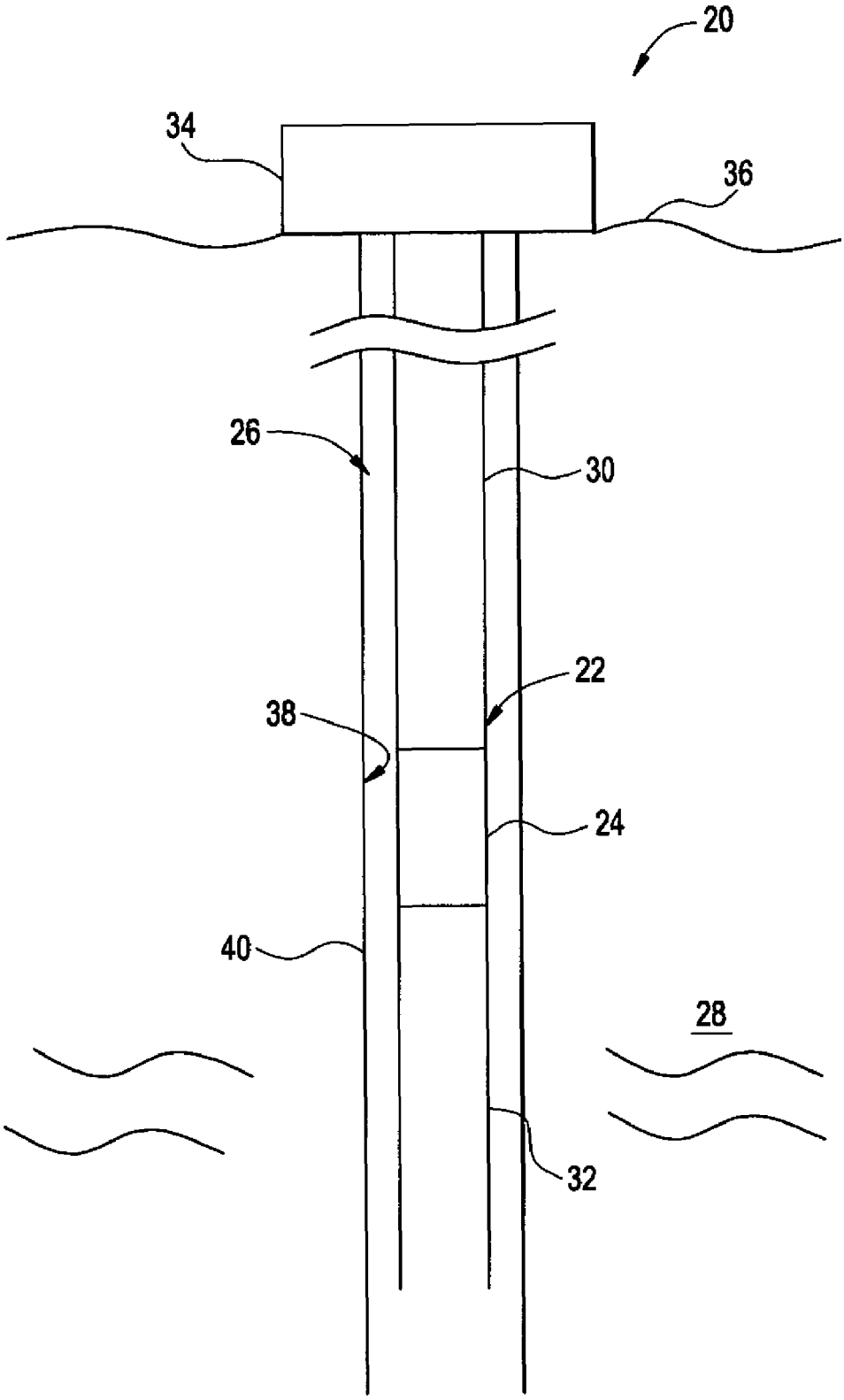
FIG. 1 is a front elevation view of a completion string with a contraction joint positioned in a wellbore, according to an embodiment of the present invention.

Referring generally to FIG. 1, a well system 20 is illustrated according to one embodiment of the present invention. Well system 20 comprises a completion string 22 having a contraction joint 24. The completion string 22 and contraction joint 24 are deployed in a wellbore 26 that is drilled or otherwise formed in a geological formation 28. The completion string 22 is deployed downhole by an appropriate deployment system 30 that may be a tubing string formed of, for example, coil tubing or jointed tubing. Contraction joint 24 generally is positioned between deployment system 30 and the operational well equipment 32 of completion string 22.

As illustrated, deployment system 30 extends downwardly along wellbore 26 from a wellhead 34 positioned at a surface 36, such as a seabed floor or the surface of the earth. The wellbore 26 is defined by a wellbore wall 38 that may be an open wellbore wall or a wellbore casing 40. Following initiation of a completion string related operation, the contraction joint 24 is free to move in a contracting or expanding direction to compensate for relative lineal movement between deployment system 30 and the well equipment 32 of completion string 22. As described in greater detail below, contraction joint 24 is designed to enable the routing of a plurality of communication lines downhole in a manner that does not tangle or detrimentally stress the communication lines during contraction and/or expansion of the contraction joint 24.

Figure 2:
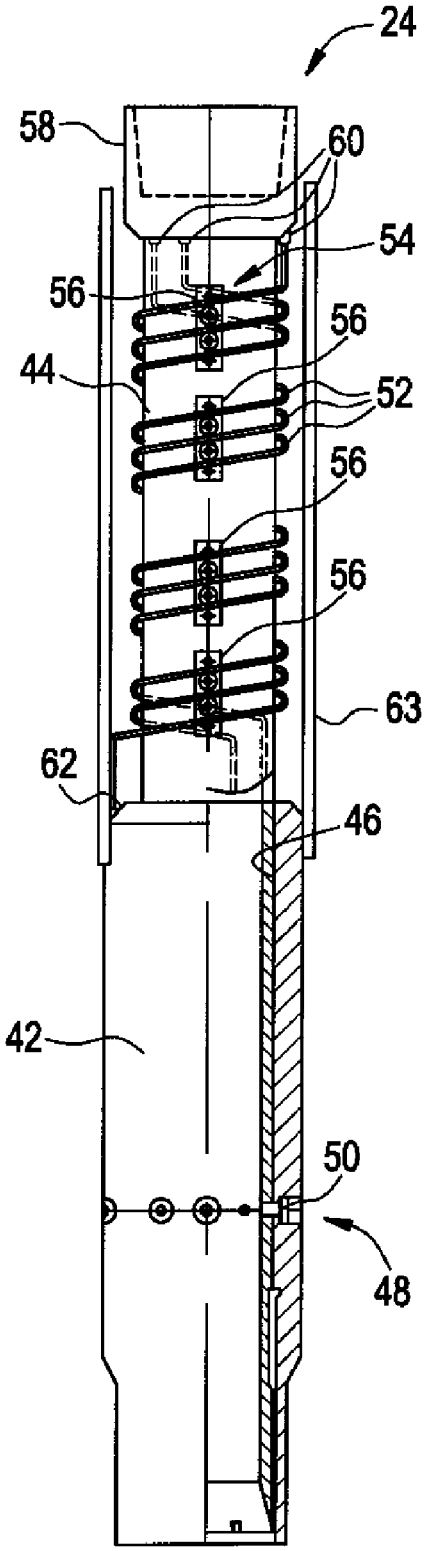
FIG. 2 is a partial cross-sectional view of the contraction joint illustrated in FIG. 1, according to an embodiment of the present invention.

Referring generally to FIGS. 1 and 2, one embodiment of contraction joint 24 is illustrated. In this embodiment, contraction joint 24 comprises a housing 42 slidably engaged with a mandrel 44 to enable contraction and expansion of contraction joint 24. In this example, mandrel 44 slides within housing 42 along an internal passage 46 formed linearly through housing 42 so as to allow telescopic motion of mandrel 44 with respect to housing 42. While completion string 22 is run into wellbore 26, the mandrel 44 may initially be fixed to housing 42 by an engagement member 48. In the embodiment illustrated, engagement member comprises a shear member 50, such as a shear pin. Upon engagement of the completions downhole, e.g. engagement of well equipment 32 with a corresponding in-hole completion, shear member 50 transfers the force used for the completion engagement and is sheared during the process.

A plurality of communication lines 52 is used to conduct various signals downhole and/or uphole. The communication lines 52 can be used to conduct signals from, for example, a surface location to well equipment 32 of completion string 22 or to other components located downhole. In some applications, the communication lines 52 can be used in transferring signals upwardly from devices located in wellbore 26 to a surface location or to other locations. The communication lines may comprise hydraulic communication lines, electrical communication lines, optical communication lines, or other types of communication lines used in transferring signals. Additionally, the type and number of communication lines can vary from one well application to another. For example, three communication lines are illustrated, but other applications may utilize additional lines in many combinations as determined by the parameters of the operation.

To prevent communication lines 52 from becoming tangled or bound against mandrel 44, a line organizer 54 is utilized to manage the communication lines while enabling sufficient movement of the communication lines to accommodate the relative movement of mandrel 44 and housing 42. In the embodiment illustrated, line organizer 54 comprises a plurality of line organizer members 56 arranged along the contraction joint 24. For example, the individual line organizer members 56 may be positioned along mandrel 44, e.g. attached to mandrel 44 along an exterior surface of the mandrel. In the embodiment of FIG. 2, the line organizer members 56 are sequentially oriented along mandrel 44 to enable the generally spiral wrapping of the communication lines 52 around mandrel 44.

However, the communication lines 52 can be routed and oriented in a variety of ways. In the embodiment illustrated, for example, the communication lines 52 extend into an upper mounting end 58 of mandrel 44 via a plurality of fittings 60. Upper mounting end 58 is used to couple contraction joint 24 with deployment system 30. The communication lines 52 extend downwardly from fittings 60 and are attached, separated, and supported by line organizer members 56 before being routed into housing 42 via line fittings 62. In other embodiments, however, communication lines 52 can be routed along other paths, including paths that run internally or externally of upper mounting end 58 and housing 42.

Additionally, a shroud 63 can be installed around the communication lines 52. In the embodiment illustrated, shroud 63 is installed outside communication lines 52 and line organizer 54 at the region where the communication lines extend along, e.g. are wrapped around, mandrel 44. The shroud 63 protects communication lines 52 from damage during operations. Also, shroud 63 is spaced from mandrel 44 a sufficient distance to serve as an envelope within which the communication lines 52 can move smoothly during contraction and expansion of contraction joint 24. The shroud 63 is illustrated as attached to housing 42, however it can be connected to other components or comprise other configurations while protecting the communication lines and ensuring smooth operation of the contraction joint.

Figure 3:
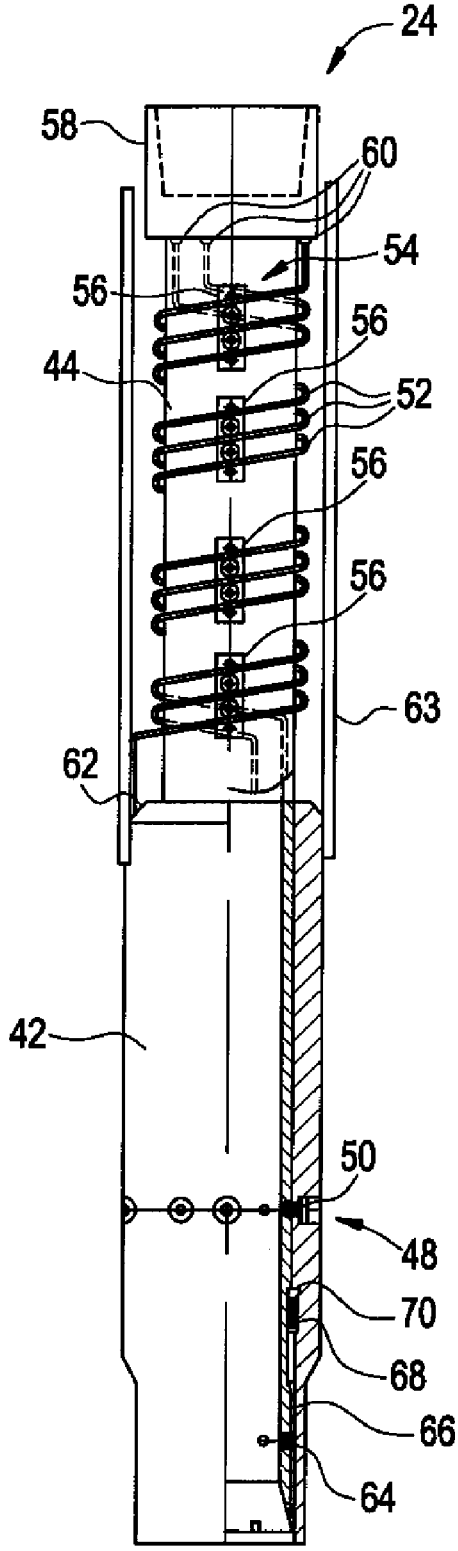
FIG. 3 is a partial cross-sectional view of another contraction joint, according to an alternate embodiment of the present invention.

Another embodiment of contraction joint 24 is illustrated in FIG. 3. The embodiment of FIG. 3 is similar to that described with reference to FIG. 2, but the contraction joint is re-settable. In other words, the housing 42 and mandrel 44 can be temporarily fixed or set at more than one position. By way of example, housing 42 and mandrel 44 may be temporarily fixed to one another by shear member 50, e.g. a shear pin, at a first position. The housing 42 and mandrel 44 also can be temporarily fixed to one another by a secondary shear member 64, e.g. a shear pin, at a second position. In this example, secondary shear member 64 engages a lock ring 66 mounted along the outer surface of mandrel 44. Another locking ring 68, such as a C-ring, is held in position along an interior of housing 42 by, for example, a shoulder 70 or other holding member.

The contraction joint 24 and well equipment 32 are moved downhole with housing 42 and mandrel 44 locked at the first position via shear member 50. Subsequently, the mandrel 44 can be pulled upwardly within housing 42 to shear the shear member 50. The mandrel 44 is moved upwardly until lock ring 66 engages corresponding lock ring 68 to temporarily fix mandrel 44 with respect to housing 42 at the second position. During a subsequent operation, the mandrel can be pushed downwardly to shear the secondary shear member 64. At this stage, the contraction joint 24 is free to contract and expand intermediate deployment system 30 and well equipment 32. In this embodiment, the contraction joint 24 again may comprise shroud 63 installed outside of communication lines 52 and line organizer 54 for guiding and protecting the communication lines 52 and line organizer 54. Shroud 63 may be mounted to either housing 42 or mandrel 44. Alternatively, shroud 63 may be formed as a telescoping shroud mounted to both housing 42 and mandrel 44.

Figure 4:
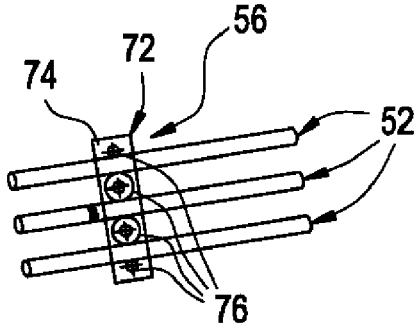
FIG. 4 is an orthogonal view of a communication line organizer member, according to an embodiment of the present invention.

The line organizer 54 can be formed with various numbers of line organizer members 56 positioned at various locations along mandrel 44 and/or housing 42. The arrangement of line organizer members 56 is selected to accommodate the number of communication lines, the type of communication lines, the routing path for the communication lines, and the general design/application of the contraction joint 24. One example of line organizer member 56 is illustrated in FIG. 4. In this embodiment, the line organizer member 56 comprises an organizer plate 72 that may be mounted to mandrel 44 or to other features of contraction joint 24. The organizer plate 72 comprises one or more plate members positioned inside and/or outside of the multiple communication lines 52. For example, organizer plate 72 may comprise a backing plate 74, positioned between mandrel 44 and communication lines 52, and a plurality of protrusions 76 extending from backing plate 74. The protrusions 76 are positioned to separate the communication lines 52 and to support the individual communication lines, i.e. provide a bearing surface for the individual communication lines. This allows the communication lines 52 to move along the surface of mandrel 44 smoothly without risk of binding or entanglement. The protrusion 76, or other bearing surfaces described herein, can be made from a material, e.g. non-metallic material/plastic material, selected to facilitate movement of the communication lines 52 along the surface of the mandrel.

Figure 5:
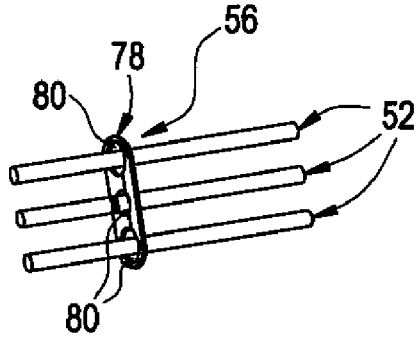
FIG. 5 is an orthogonal view of another communication line organizer member, according to an alternate embodiment of the present invention.
Figure 6:
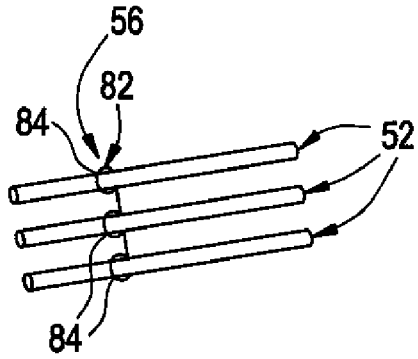
FIG. 6 is an orthogonal view of another communication line organizer member, according to an alternate embodiment of the present invention.

Another embodiment of line organizer member 56 is illustrated in FIG. 5. In this embodiment, each line organizer member 56 comprises a retainer plate 78 having a plurality of openings 80 through which individual communication lines 52 extend. The retainer plate 78 is thus able to separate and support the individual communication lines while allowing movement of the communication lines 52 along the surface of mandrel 44, thereby protecting the communication lines against binding or entanglement. Alternatively, an organizer wire 82 can be used to separate and support individual communication lines, as illustrated in FIG. 6. The organizer wire 82 comprises a plurality of loop or ring sections 84 sized to fit around each communication line and thus support each individual line.

Figure 7:
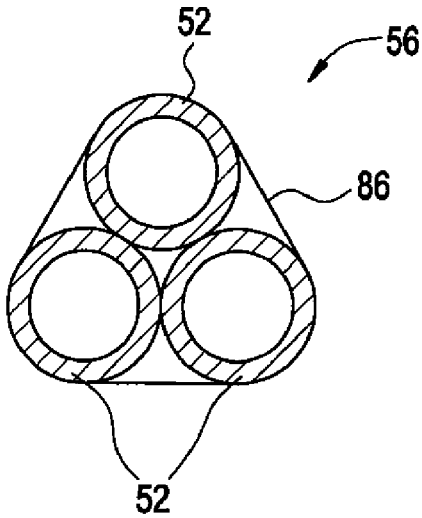
FIG. 7 is an orthogonal view of another communication line organizer member, according to an alternate embodiment of the present invention.

In other embodiments, each line organizer member 56 may be formed to hold the communication lines 52 in a group, as in the embodiments illustrated in FIGS. 7-10. In the embodiment of FIG. 7, for example, three communication lines 52 are held together in a triangular configuration by an outer wrap 86 or other similar member. The outer wrap 86 is positioned around the communication lines to securely hold the position of the communication lines and thus avoid entanglement of the communication lines during expansion and contraction of contraction joint 24.

Figure 8:
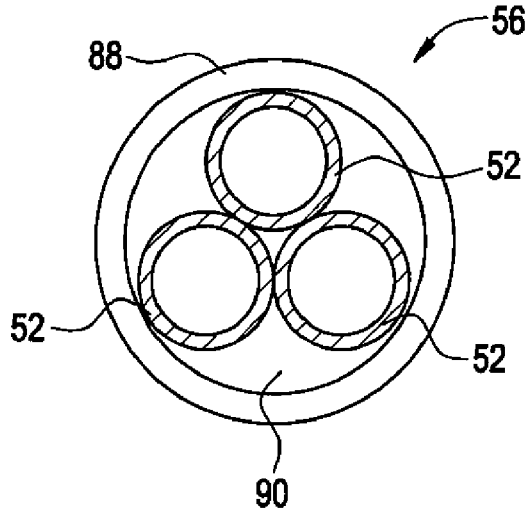
FIG. 8 is an orthogonal view of another communication line organizer member, according to an alternate embodiment of the present invention.

The line organizer members 56 also may be formed as tubular members designed to hold the communication lines in a desired cross-sectional configuration to avoid entanglement while allowing sufficient movement of the communication lines to facilitate expansion and contraction of contraction joint 24. In the embodiment of FIG. 8, for example, the line organizer member 56 comprises an organizer frame 88 having a circular configuration sized to retain the desired number of communication lines at specific positions within an interior 90 of circular organizer frame 88. For example, if three communication lines are used, frame 88 may be sized to hold the communication lines in the illustrated, triangular orientation when viewed in cross-section.

Figure 9:
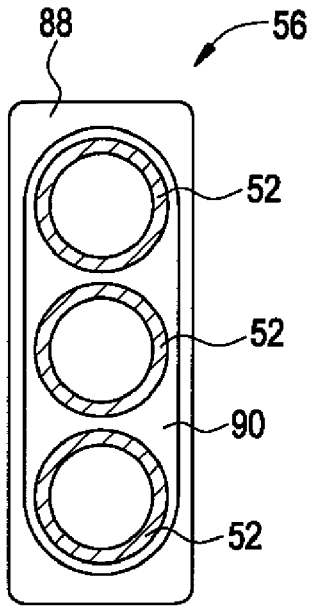
FIG. 9 is an orthogonal view of another communication line organizer member, according to an alternate embodiment of the present invention.
Figure 10:
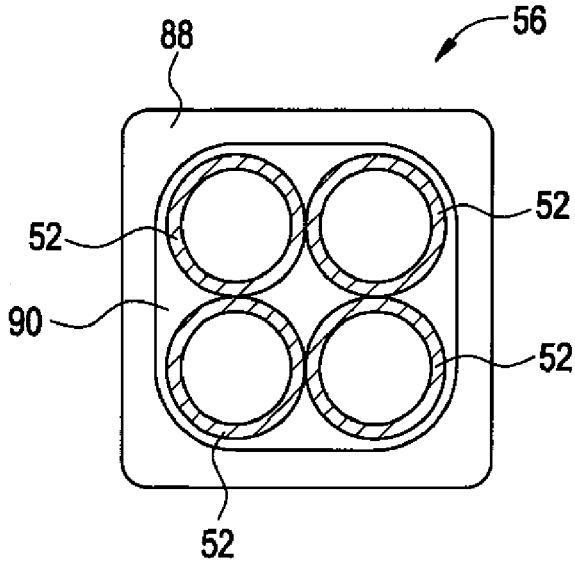
FIG. 10 is an orthogonal view of another communication line organizer member, according to an alternate embodiment of the present invention.

Tubular organizer members also can be formed in other shapes, such as the rectangular shape illustrated in FIG. 9. In this embodiment, organizer frame 88 is rectangular and sized to retain a plurality of communication lines 52 in a linear arrangement within interior 90. The interior 90 may have a generally oval shape designed to secure the outlying communication lines as well as those therebetween when the communication lines 52 are viewed in cross-section. Another example is illustrated in FIG. 10 in which the organizer frame 88 has a generally square shape sized to secure the orientation of, for example, four communication lines 52. The size and shape of organizer frame 88 can be adjusted according to the type and number of communication lines.

The design of contraction joint 24 and the overall completion string 22 can be selected according to the desired well operation and well environment. Additionally, the type and number of communication lines also can change depending on the specific application for which they are used in conducting signals downhole and/or uphole. The line organizers also can have differing numbers of line organizer members and line organizer member configurations to properly secure the communication line orientation while enabling the free contraction and expansion of the contraction joint.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system, comprising:

a well completion having:

a contraction joint;

a plurality of communication lines; and a line organizer mounted on the contraction joint, the line organizer being arranged to prevent tangling of the plurality of communication lines while enabling sufficient movement of the plurality of communication lines to accommodate expansion and contraction of the contraction joint.

2. The system as recited in claim 1, wherein the contraction joint comprises a mandrel slidably received in a housing.

3. The system as recited in claim 2, wherein the mandrel and the housing are initially fixed to each other with a shear member.

4. The system as recited in claim 1, wherein the plurality of communication lines comprises at least two communication lines.

5. The system as recited in claim 1, wherein the line organizer comprises a plurality of organizer plates attached to the mandrel.

6. The system as recited in claim 5, wherein each organizer plate of the plurality of organizer plates comprises a backing plate and a plurality of protrusions extending from the backing plate to support individual communication lines of the plurality of communication lines.

7. The system as recited in claim 5, wherein each organizer plate of the plurality of organizer plates comprises a retainer plate having openings through which individual communication lines of the plurality of communication lines pass.

8. The system as recited in claim 1, wherein the line organizer comprises an organizer wire bent to support the plurality of communication lines.

9. The system as recited in claim 1, wherein the line organizer comprises a tubular member through which the plurality of communication lines extends.

10. A system for use in a wellbore, comprising:

a contraction joint having a mandrel and a housing slidably engaged to enable contraction and expansion of the contraction joint, the contraction joint further comprising a line organizer positioned to support a plurality of communication lines extending along the contraction joint, the line organizer being oriented to prevent tangling of the plurality of communication lines while enabling sufficient movement of each communication line to accommodate expansion and contraction of the contraction joint.

11. The system as recited in claim 10, wherein the contraction joint further comprises a shear member to initially fix the mandrel relative to the housing.

12. The system as recited in claim 10, wherein the contraction joint can be reset.

13. The system as recited in claim 10, wherein the line organizer comprises a plurality of line organizer members mounted to the mandrel.

14. The system as recited in claim 13, wherein of the plurality of line organizer members comprises at least one selected from the following: a plurality of plates mounted to the mandrel, and tubular members through which the communication lines extend.

15. The system as recited in claim 10, further comprising a shroud surrounding the line organizer.

16. A method, comprising:

deploying a well completion into a wellbore with a contraction joint;

routing a plurality of communication lines along the contraction joint; and preventing tangling of the plurality of communication lines during use of the contraction joint via line organizer members positioned along the contraction joint.

17. The method as recited in claim 16, wherein routing comprises arranging the plurality of communication lines in a spiral around the contraction joint.

18. The method as recited in claim 16, wherein preventing comprises supporting individual communication lines at each line organizer member.

19. The method as recited in claim 16, wherein preventing comprises forming each line organizer member with a tubular portion through which the plurality of communication lines is routed.

20. The method as recited in claim 16, further comprising forming the contraction joint with a telescoping housing and mandrel temporarily fixed with a shear member.

21. The method as recited in claim 16, further comprising mounting a shroud on the contraction joint to protect the plurality of communication lines.

22. A method, comprising:

slidably engaging a housing and a mandrel to form a contraction joint;

locating a plurality of line organizer members on at least one of the mandrel and the housing to prevent tangling of communication lines; and incorporating the contraction joint into a well completion.

23. The method as recited in claim 22, further comprising spirally wrapping a plurality of communication lines around the mandrel and engaging the communication lines with the plurality of line organizer members.

24. The method as recited in claim 22, further comprising routing communication lines along the contraction joint, and supporting the communication lines at each line organizer member.

* * * * *